US006422951B1

(12) United States Patent
Burrows

(10) Patent No.: US 6,422,951 B1
(45) **Date of Patent: *Jul. 23, 2002**

(54) METAL WOOD TYPE GOLF CLUB HEAD

(76) Inventor: Bruce D. Burrows, P.O. Box 802948, Santa Clarita, CA (US) 91380-2948

( * ) Notice: Subject to any disclaimer, the term of this patent is extended or adjusted under 35 U.S.C. 154(b) by 0 days.

This patent is subject to a terminal disclaimer.

(21) Appl. No.: 09/807,847

(22) PCT Filed: Nov. 9, 1998

(86) PCT No.: PCT/US98/23839

§ 371 (c)(1),
(2), (4) Date: Apr. 19, 2001

(87) PCT Pub. No.: WO00/27484

PCT Pub. Date: May 18, 2000

Related U.S. Application Data

(63) Continuation-in-part of application No. 08/797,303, filed on Jan. 7, 1997, now Pat. No. 5,851,159.

(51) Int. Cl.[7] ..... A63B 53/04

(52) U.S. Cl. ..... 473/328; 473/345; 473/346

(58) Field of Search ..... 473/345, 346, 473/328, 349, 350, 286, 344, 327; D21/733, 752

(56) References Cited

U.S. PATENT DOCUMENTS

| | | | | |
|---|---|---|---|---|
| 1,526,438 | A | | 2/1925 | Scott |
| 1,541,126 | A | | 6/1925 | Dunn |
| 2,550,846 | A | | 5/1951 | Milligan |
| 3,300,241 | A | | 1/1967 | Eberwein et al. |
| 4,021,047 | A | * | 5/1977 | Mader |
| 4,432,549 | A | | 2/1984 | Zebelean |
| 4,438,931 | A | * | 3/1984 | Motomiya |
| 4,534,564 | A | | 8/1985 | Yamada |
| 4,850,593 | A | | 7/1989 | Nelson |
| 4,900,029 | A | | 2/1990 | Sinclair |
| 5,004,241 | A | | 4/1991 | Antonious |
| 5,205,560 | A | | 4/1993 | Hoshi et al. |
| 5,213,328 | A | | 5/1993 | Long et al. |
| 5,273,283 | A | | 12/1993 | Bowland |
| 5,294,037 | A | | 3/1994 | Schmidt |
| D354,103 | S | | 1/1995 | Allen |
| 5,429,365 | A | | 7/1995 | McKeighen |
| 5,441,263 | A | | 8/1995 | Gorman |
| D385,003 | S | * | 10/1997 | Burrows |
| 5,851,159 | A | * | 12/1998 | Burrows |

FOREIGN PATENT DOCUMENTS

| | | |
|---|---|---|
| TW | 296631 | 1/1997 |

* cited by examiner

*Primary Examiner*—Sebastiano Passaniti
(74) *Attorney, Agent, or Firm*—Kelly Bauersfeld Lowry & Kelley, LLP

(57) ABSTRACT

A golf club head (10) of the metal wood-type is provided, wherein the sole plate (12) of the club head (10) includes a downwardly open recess (16) defined by a generally centrally located dome element (14). Internal stiffening ribs (36) may be provided within the club head to extend between the dome element (14) and a selected club head side wall, preferably such as the front or ball impact face (24) of the club head.

20 Claims, 5 Drawing Sheets

FIG. 3
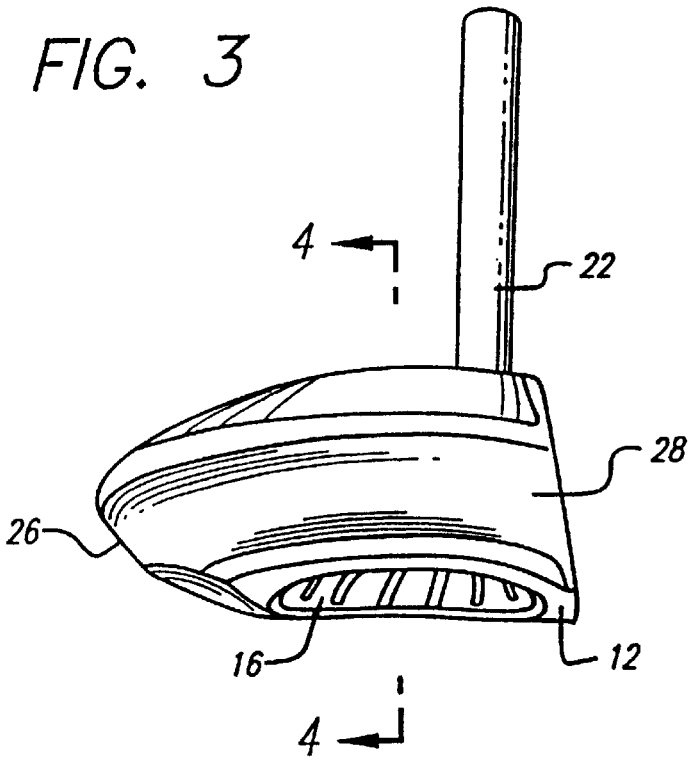
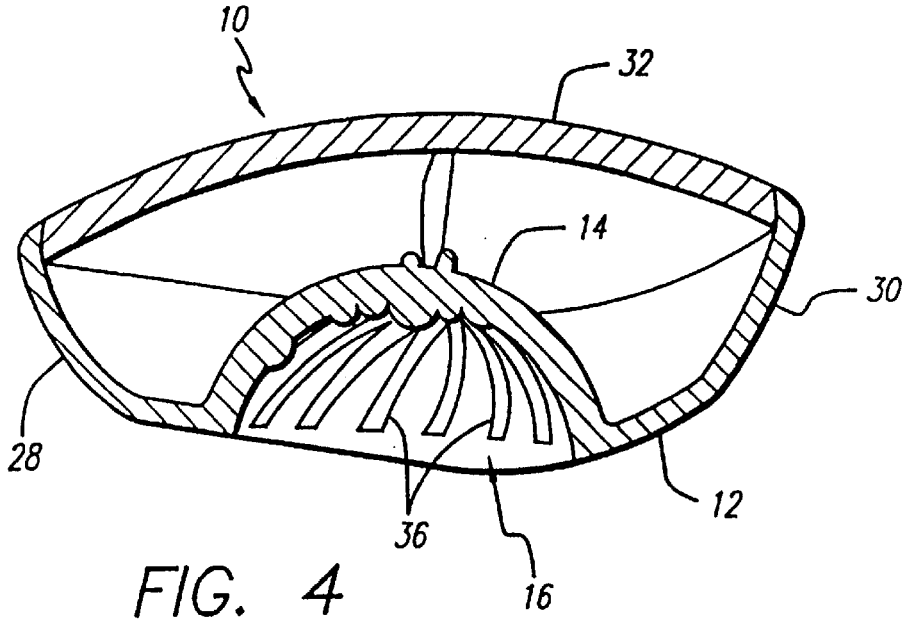
FIG. 4

FIG. 5
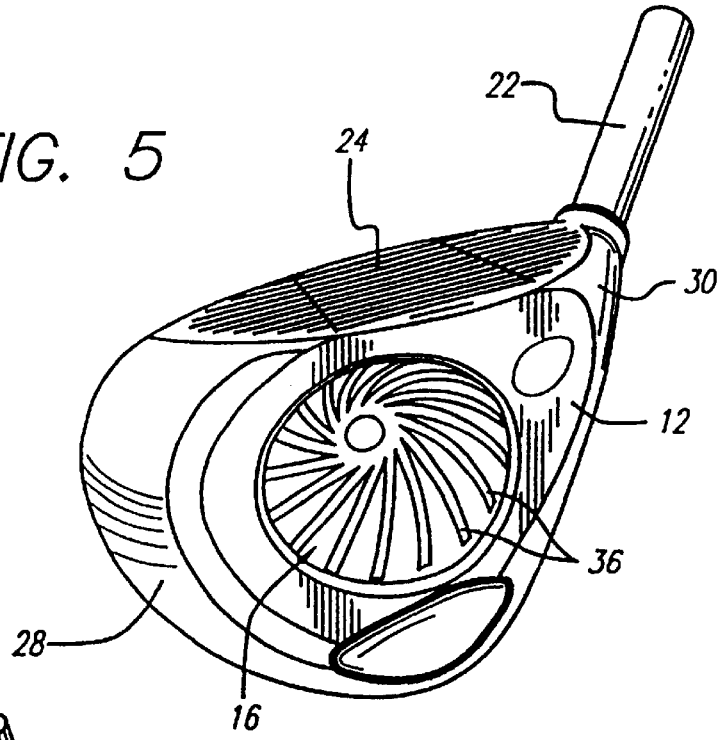
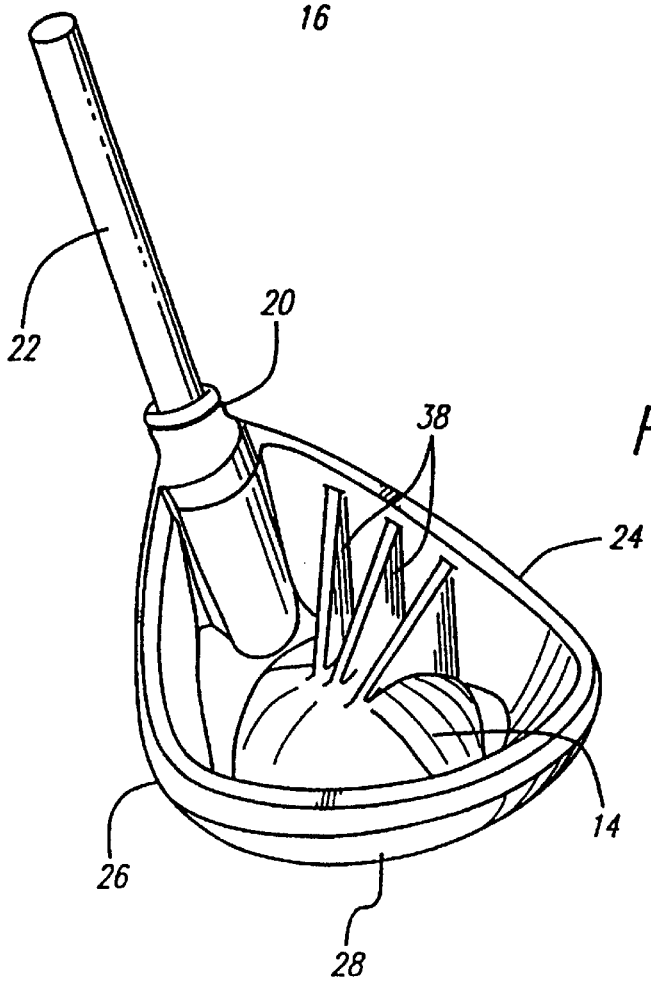
FIG. 6

METAL WOOD TYPE GOLF CLUB HEAD

This application is a continuation-in-part of copending U.S. Ser. No. 08/797,303, filed Jan. 7, 1997, now U.S. Pat. No. 5,851,159, issued Dec. 22, 1998.

BACKGROUND OF THE INVENTION

This invention relates generally to improvements in golf club heads of the metal wood type. More specifically, this invention relates to a metal wood type club head which exhibits improved weight distribution and head stiffness.

Golf club heads of the so-called metal wood type are generally known in the art, wherein the shape of a traditional wood-type club head is reproduced in the form of a hollow metal shell. In a typical construction, the club head comprises a base member which is formed by casting or forging or the like in an upwardly open shell-shaped configuration to define a sole plate and upstanding club side walls, including a front face for striking a golf ball. The base member additionally includes a hosel for suitable connection to the end of a golf club shaft. The top of the base member is closed by a cap plate which is typically welded thereto, to form the hollow metal head structure. In an alternative configuration, the base member of the club head can be formed as a downwardly open shell, and a sole plate is attached thereto as by welding to form the hollow club head.

Significant developmental effort has been directed to improving metal wood-type golf clubs, to improve distance, accuracy, and overall playability in different conditions. Much of this effort has been directed to enhancement of club head weight distribution, structural stiffness, and aerodynamics.

The present invention is directed to further improvements in a golf club head of the metal wood type, with improved club head weighting and structural stiffness features.

SUMMARY OF THE INVENTION

A golf club head of metal wood type is provided, wherein the club head comprises a hollow structure adapted for suitable attachment to the end of a golf club shaft. The improved golf club head includes a sole plate defining a downwardly open recess formed by an upwardly arched, generally centrally positioned dome element. The dome element effectively raises the club head center of gravity and enhances the overall stiffness and structural integrity of the club head upon ball impact. In addition, the dome element significantly enhances club playability in tall grass. The dome element may be constructed as an integral portion of the sole plate or alternately, constructed from a different material which may be lighter than or heaver than the sole plate material and adapted for attachment to the sole plate.

In one preferred form, the club head is defined by an upwardly open, generally cup-shaped base member which defines the sole plate and upwardly projecting side walls, including a front face, a rear face, a heel segment, and a toe segment. The dome element incorporated into or otherwise attached to the sole plate defines the downwardly open recess, of a part-spherical and preferably semi-spherical configuration. The diametric size of the dome element is sufficient to extend with an opening size at least one-firth and preferably about one-half of the distance between the heel and toe wall segments, and further to extend with a depth upwardly into the club head interior by a distance at least one-fifth and preferably about one-half the distance between the sole plate and a cap plate.

A plurality of stiffening ribs may be formed to extend integrally between an upper side of the dome element, within the interior of the base member, and an inboard side of the club head front face to provide substantial stiffening reinforcement particularly in the vicinity of a ball striking zone or "sweet spot". The cap plate is further provided and has a size and shape for secure attachment as by welding onto the base member to form a fully enclosed, hollow club head.

In an alternative form of the invention, the base member of the club head can be formed as a downwardly open shell to include the cap plate and the club head side walls, as previously defined. In this version, a sole plate is provided for secure attachment as by welding to the base member to define the enclosed, hollow club head. The dome element, as defined above, is incorporated into or otherwise suitably attached to the sole plate.

The metal wood type club head produces a unique audible sound when impacted with a golf ball. In addition, the club head results in a substantially reduced transmission of vibration and related vibrational energy to the club shaft. It is believed that energy associated with a shock wave arising upon ball impact is transmitted by the dome element as sound, instead of transmission as vibrational energy to the club shaft. The sound emanating from the club head on ball impact is believed to be unique and distinct in terms of loudness and/or frequency.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a left or toe-side elevational view of the golf club depicted in FIG. 1;

FIG. 4 is a vertical sectional view taken generally on the line 4—4 of FIG. 3;

FIG. 5 is a perspective view illustrating the bottom of the golf club head;

FIG. 6 is a fragmented perspective view similar to a portion of FIG. 2, illustrating the golf club head with a cap plate removed to reveal internal construction details of the golf club head;

DETAILED DESCRIPTION OF THE PREFERRED EMBODIMENTS

Figure 1:
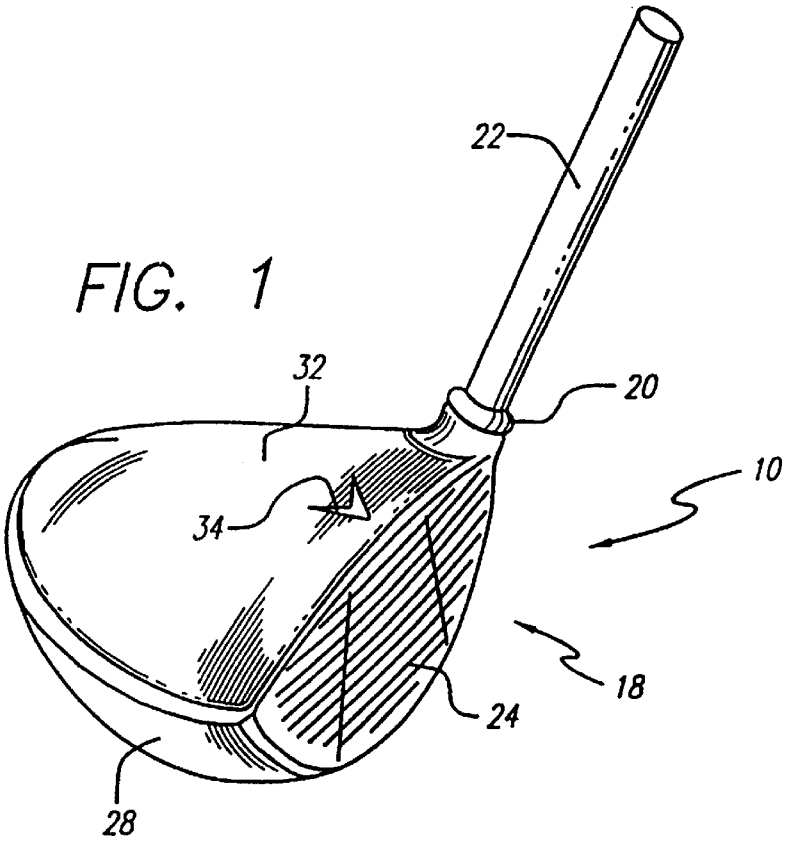
FIG. 1 is a perspective view illustrating a metal wood-type golf club head embodying the novel features of the invention.
Figure 2:
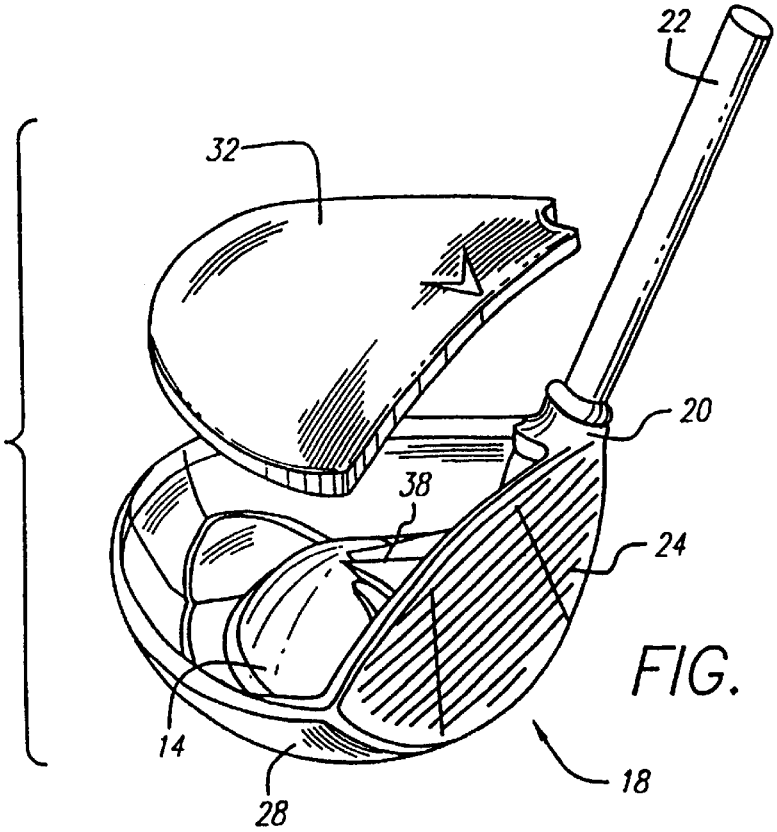
FIG. 2 is an exploded perspective view illustrating components of the golf club head of FIG. 1.

As shown in the exemplary drawings, an improved metal wood type golf club head referred to generally by the reference numeral 10 is provided with a sole plate 12 having a raised dome element 14 of substantial size and shape formed therein. The dome element 14 defines a downwardly open cavity or recess 16 in the bottom of the enclosed and hollow club head 10, wherein this club head geometry provides improvements in club head weight distribution, structural stiffness, and playability in certain conditions.

The overall construction of the illustrative golf club head 10 generally conforms to existing metal wood technology, wherein an enclosed and hollow metal club head is formed from metal components which are typically cast or forged from stainless steel, titanium, or other selected metal or metal alloy. The club head includes a base member 18 (FIGS. 2 and 6) including a hosel 20 for suitable attachment to the lower end of a club shaft 22. As shown in the embodiment of FIGS. 1–6, the base member 18 is formed as an upwardly open shell to include the sole plate 12 joined at its perimeter to upstanding side walls of the club head, namely, a front face 24 for striking a golf ball, a rear face 26, a toe region or segment 28, and a heel region or segment 30. These upstanding side walls of the base member 18 are adapted for assembly with and secure attachment to a cap plate 32 which is normally welded thereto and then appropriately surface finished to provide an attractive hollow metal club head.

In accordance with the invention, the sole plate 12 includes the raised dome element 14 defining the downwardly open recess 16. This dome element 14, as shown best in FIG. 4, has a generally hemispherical shape and is disposed generally centrally within the club head 10. A vertical axis of the dome element 14 is desirably centered on or aligned with a ball impact point or sweet spot, which can be indicated by an arrow 34 formed near a forward margin of the cap plate 32. The dome element 14 has a substantial size and shape, relative to the club head as a whole. In particular, the dome element has an opening size sufficient to span at least one-fifth and preferably about one-half of the heel-to-toe dimension of the club head, as measured by the maximum width of the front impact face 24. In addition, the dome element 14 has a radial size or depth sufficient to extend upwardly from the sole plate 12 by a distance at least one-fifth and preferably about one-half the height dimension between the sole plate 18 and cap plate 32, as measured by the maximum height of the front impact face 24. The preferred dome element includes a spiral pattern of ribs 36 formed on the concave side thereof, wherein these ribs 36 are distinctly visible on the underside of the club particularly when the club is carried in a golf bag.

With this construction, the dome element 14 effectively alters the center of gravity of the club head 10, by shifting mass upwardly from the plane of the sole plate 12 to a position more closely aligned with the optimum sweet spot for ball impact. This upward shift in club weighting, which can be controlled by selecting the thickness of the head wall defining the dome element, is believed to enhance performance consistency. In addition, the shape of the dome element 14 is further believed to improve club head stiffness and structural integrity, particularly with respect to reducing trampoline effect of the front striking face 24 upon ball impact. The club head effectively and substantially reduces the transmission of vibrational energy to the club shaft upon ball impact, but instead is believed to transmit this energy as sound in the form of a unique and distinct audible output in terms of frequency and/or decibel level. Further benefits include improved playability in certain conditions such as tall grass, since the recess 16 defined by the dome element 14 allows the club head to move through tall grass more smoothly and with less resistance. The dome element also facilitates a more accurate address of the ball in tall grass. In this regard, although the dome element 14 is shown with a part-spherical shape, it will be understood that other specific cavity-forming geometries may be used.

The structural stiffness of the club head 10 can be further enhanced by the addition of internal stiffening or reinforcement ribs 38 extending between the dome element 14 and the inboard side of a selected upstanding side wall, such as the ball impact face 24. These stiffening ribs 38 are shown best in FIG. 6, with three ribs formed integrally with the dome element and front face, to extend therebetween within the club head interior. The ribs 38 are generally centered on the ball impact sweet spot to provide maximum stiffness in that area.

Figure 7:
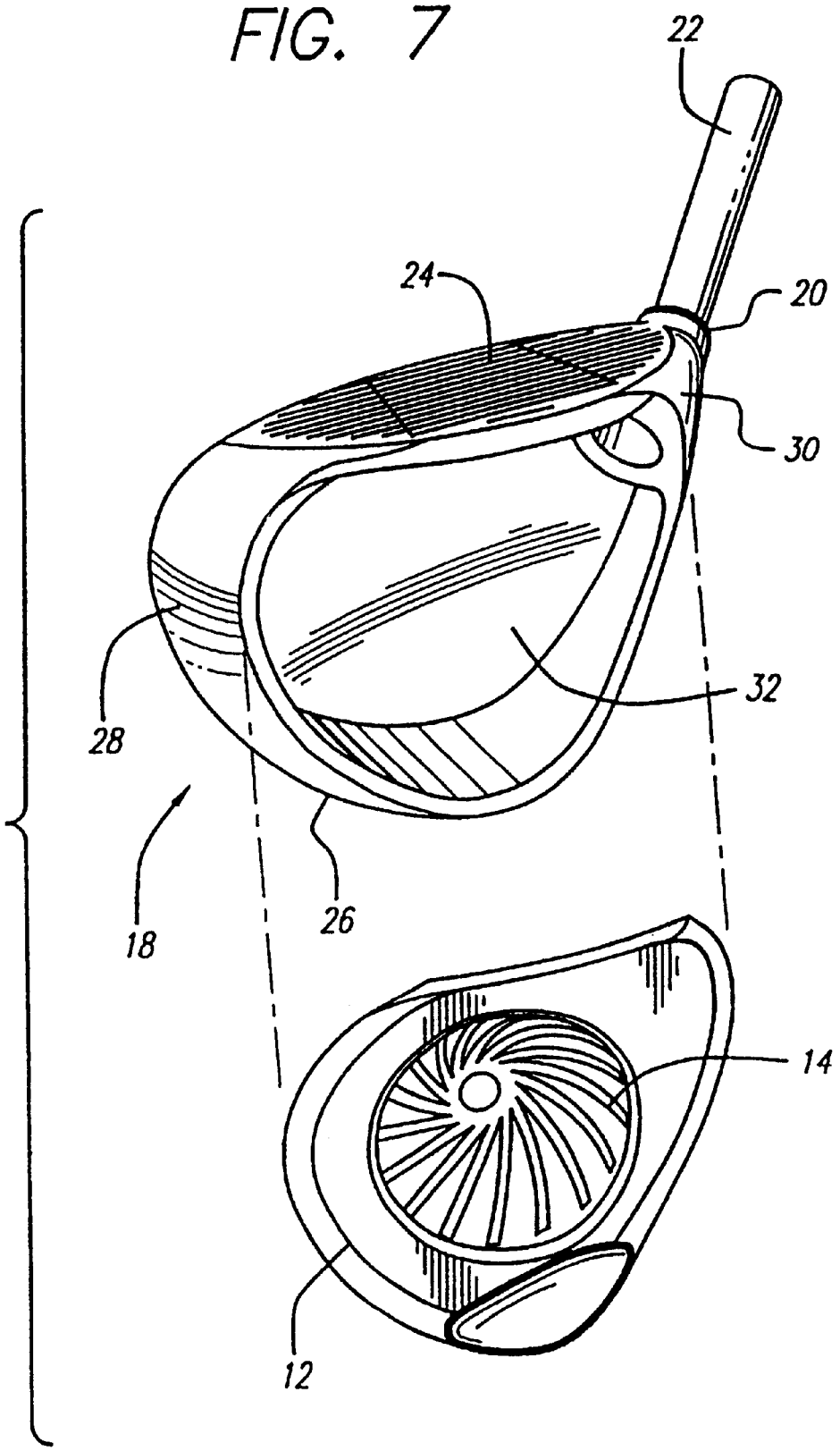
FIG. 7 is an exploded perspective view illustrating an alternative preferred form of the invention.

FIG. 7 depicts an alternative form of the invention wherein the dome element 14 is again formed within the sole plate 12, but wherein the sole plate 12 is designed for mounting onto a modified base member 18' constructed as a downwardly open shell. More particularly, in this version, the base member 18' is formed to include the upstanding side walls 24, 26, 28 and 30 of the club head integral with the cap plate 32. This modified base member 18' again includes the hosel 20 for attachment to a club shaft 22. The base member 18' is designed for attachment to the sole plate 12 having the dome element 14 formed therein. When assembled, the modified club head shown in FIG. 7 provides the same performance benefits and advantages described with respect to FIGS. 1–6, except that internal stiffening ribs 38 (FIG. 6) are not integrally formed between the dome element and ball impact face.

Figure 8:
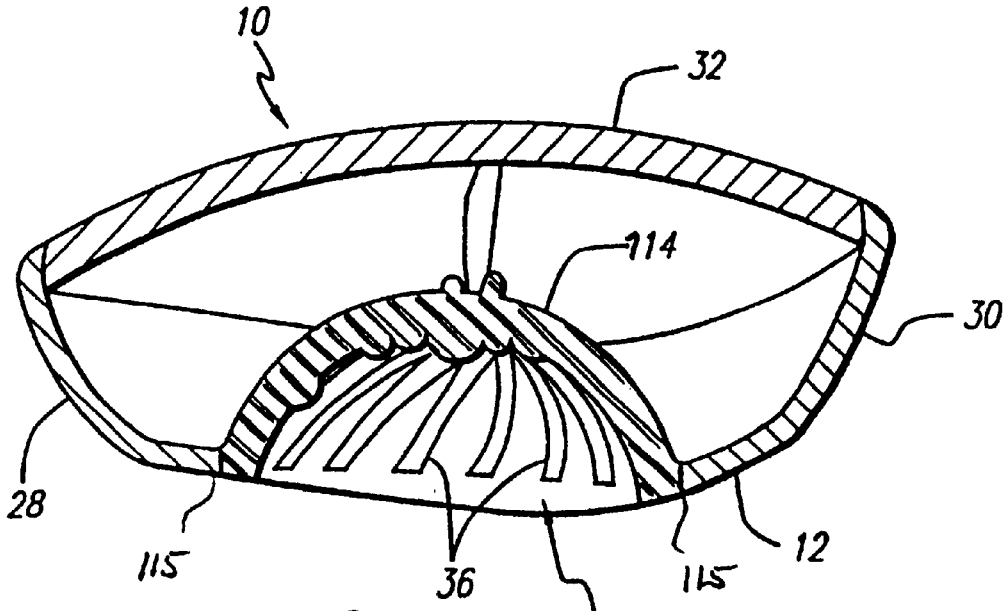
FIG. 8 is a vertical sectional view similar to FIG. 4 illustrating a further alternative preferred form of the invention.

FIG. 8 shows another alternative form, wherein a modified dome element 114 is assembled with the sole plate 12, as opposed to being formed integrally therewith as shown in FIG. 4. In FIG. 8, the modified dome element 114 is formed from a different material than the remainder of the sole plate 12, e.g., a lighter material such as plastic or a different metal which may be heavier, to tailor the specific club weight and center of gravity characteristics. The dome element 114 is suitably attached to the sole plate 12 as by a weld on adhesive joint 115. Importantly, this concept of a separately formed and mounted dome element may also be used in the embodiment of FIG. 7.

A variety of further modifications and improvements to the metal wood type golf club heads of the present invention will be apparent to those persons skilled in the art. Accordingly, no limitation on the invention is intended by way of the foregoing description and accompanying drawings, except as set forth in the appended claims.

What is claimed is:

1. A golf club head, comprising:

a head formed from assembled first and second head members to define, when assembled, a sole plate, a front wall and a rear wall and a heel segment and a toe segment generally upstanding from said sole plate and having upper margins thereof joined to a cap plate to define a hollow enclosed head construction;

a generally hemispherical dome element disposed generally centrally on said sole plate and defining a downwardly open cavity.

2. The golf club head of claim 1 wherein said first head member comprises a base member including said sole plate joined to said front and rear walls and to said heel and toe segments, said second head member comprising said cap plate.

3. The golf club head of claim 2 further including at least one stiffening rib connected between said dome element and an inboard side of a selected one of said front and rear walls and said heel and toe segments.

4. The golf club head of claim 3 wherein said stiffening rib is connected between said dome element and said front wall.

5. The golf club head of claim 3 wherein said rib is integrally formed with said dome element and said selected one of said front and rear walls and said heel and toe segments.

6. The golf club head of claim 1 wherein said first head member comprises a base member including said cap plate joined to said front and rear walls and to said heel and toe segments, and wherein said second head member comprises said sole plate.

7. The golf club head of claim 1 wherein said dome element has an opening size extending at least one-fifth to be about one-half the maximum heel-to-toe width dimension of said front wall of the club head.

8. The golf club head of claim 1 wherein said dome element has a depth extending at least one-fifth to about one-half the maximum height of said front wall of the club head.

9. The golf club head of claim 1 further including at least one stiffening rib connected between said dome element and an inboard side of said front wall of the club head.

10. The golf club head of claim 1 wherein said dome element is formed integrally with said sole plate.

11. The golf club head of claim 10 wherein said first and second head members are formed from metal.

12. The golf club head of claim 1 wherein said dome element is assembled with said sole plate.

13. A golf club head, comprising:

a head formed from assembled first and second head members to define, when assembled, a sole plate, a front wall and rear wall and a heel segment and a toe segment generally upstanding from said sole plate and having upper margins thereof joined to a cap plate to define a hollow enclosed head construction;

a dome element disposed generally centrally on said sole plate and defining a downwardly open cavity, said sole plate circumscribing said cavity at the front, rear, heel and toe sides thereof;

said cavity having an opening size extending at least about one-fifth to about one-half the maximum heel-to-toe dimension of said front wall of the club head, and said cavity having a depth extending at least about one-fifth to about one-half the maximum height of said front wall of the club head.

14. The golf club head of claim 13 further including at least one stiffening rib connected between said dome element and an inboard side of said front wall.

15. The golf club head of claim 13 wherein said dome element is formed integrally with said sole plate.

16. The golf club head of claim 15 wherein said first and second head members are formed from metal.

17. The golf club head of claim 13 wherein said dome element is assembled with said sole plate.

18. The golf club head of claim 13 wherein said first head member comprises a base member including said sole plate joined to said front and rear walls and to said heel and toe segments, said second head member comprising said cap plate.

19. The golf club head of claim 13 wherein said first head member comprises a base member including said cap plate joined to said front and rear walls and to said heel and toe segments, and wherein said second head member comprises said sole plate.

20. The golf club head of claim 13 wherein said dome element has a generally hemispherical shape.

* * * * *